US008490805B2

(12) United States Patent
Giraud et al.

(10) Patent No.: US 8,490,805 B2
(45) Date of Patent: Jul. 23, 2013

(54) METHOD AND MACHINE FOR MAKING A STOPPER FOR THE NECK OF A CONTAINER, AND STOPPER AS PRODUCED BY THIS METHOD

(75) Inventors: Jean-Luc Giraud, Talan (FR); Michel Luzzato, Lyons (FR); Jerome Mezerette, Saint Didier Au Mont d'Or (FR); Fabien Flamand, Reyrieux (FR)

(73) Assignee: Tetra Laval Holdings & Finance S.A., Pully (CH)

( * ) Notice: Subject to any disclaimer, the term of this patent is extended or adjusted under 35 U.S.C. 154(b) by 455 days.

(21) Appl. No.: 12/741,193

(22) PCT Filed: Nov. 5, 2008

(86) PCT No.: PCT/FR2008/051991

§ 371 (c)(1), (2), (4) Date: May 3, 2010

(87) PCT Pub. No.: WO2009/068778

PCT Pub. Date: Jun. 4, 2009

(65) Prior Publication Data

US 2010/0258520 A1 Oct. 14, 2010

(30) Foreign Application Priority Data

Nov. 6, 2007 (FR) ..... 07 07790

(51) Int. Cl.
*B65D 41/32* (2006.01)

(52) U.S. Cl.
USPC ..... 215/306; 215/258; 215/253; 215/252

(58) Field of Classification Search
USPC ..... 215/252, 253, 256, 258, 305, 306, 215/317, 320, 321
See application file for complete search history.

(56) References Cited

U.S. PATENT DOCUMENTS 3,904,062 A 9/1975 Grussen
4,474,302 A 10/1984 Goldberg et al.

(Continued)

FOREIGN PATENT DOCUMENTS

EP 0619168 10/1994

*Primary Examiner* — Anthony Stashick
*Assistant Examiner* — James N Smalley
(74) *Attorney, Agent, or Firm* — Finnegan, Henderson, Farabow, Garrett & Dunner, LLP

(57) ABSTRACT

This method makes it possible to fabricate a stopper (1) starting from a tubular skirt (12) suitable for surrounding a container neck, and provided both with retainer means for retaining it permanently around the neck, and also with fastener means for fastening it removably to the neck. In this method, the skirt and a blade (110) are moved in rotation relative to each other about the axis (X-X) of the skirt so that the blade cuts a peripheral line of weakness in the skirt, which line of weakness is made up firstly of through notches and secondly, between said notches around the periphery of the skirt, of breakable bridges that interconnect, in the same direction as the axis, a non-removable portion of the skirt, which portion is provided with the retainer means, and a removable portion of the skirt, which portion is provided with the fastener means. With a view to improving the method simply and inexpensively, provision is made for the skirt and the blade to be driven relative to each other through an angular stroke that is strictly greater than 360°, while progressively modifying the relative axial position between the skirt and the blade by a movement in axial translation (T). The line of weakness is thus in the shape of a helix having its two peripheral ends defining between them a non-breakable strip that permanently interconnects the removable and the non-removable portions of the skirt.

11 Claims, 5 Drawing Sheets

U.S. PATENT DOCUMENTS 4,534,478 A * 8/1985 Sawicki ..... 215/230
4,573,602 A * 3/1986 Goldberg ..... 215/256
4,909,404 A 3/1990 Rozenberg
5,725,115 A * 3/1998 Bosl et al. ..... 215/252
5,941,404 A * 8/1999 Charrette ..... 215/305
6,460,712 B2 * 10/2002 Smith et al. ..... 215/235
2003/0066815 A1 * 4/2003 Lucas ..... 215/253
2003/0127419 A1 7/2003 Shenkar et al.
2005/0045578 A1 * 3/2005 Schwarz et al. ..... 215/252

* cited by examiner

METHOD AND MACHINE FOR MAKING A STOPPER FOR THE NECK OF A CONTAINER, AND STOPPER AS PRODUCED BY THIS METHOD

The present invention relates to a method and a machine for fabricating a stopper for a container neck. It also relates to a stopper as obtained by implementing this fabricating method.

The invention relates generally to stoppers in which each stopper has a skirt that surrounds the neck of a container and that has a bottom portion, "bottom" when the neck is extending vertically with its rim pointing upwards, that is designed to remain permanently around the neck after the stopper has been opened for the first time, while the remainder of the skirt, i.e. the top portion thereof, is designed to be removable from the neck, while initially being connected to the non-removable bottom portion of the skirt by breakable bridges that are distributed around the periphery of the skirt and that are suitable for being broken when the stopper is opened for the first time. The line of weakness formed by said bridges serves as an indicator to inform users whether or not the stopper has been opened for a first time. In the context of the present invention, the removable link between the top skirt portion and the neck of the container may be of any type, so that the invention is applicable both for screw stoppers, and also for snap-shut stoppers, i.e. stoppers that are suitable for snapping onto bottle necks.

The invention relates more particularly to stoppers in which the line of weakness is subdivided, i.e. it is made up of a succession of through notches, cut through the wall of the skirt and around the periphery thereof, in such a manner as to define respective ones of the above-mentioned breakable bridges between successive pairs of notches. Obtaining the line of weakness by cutting rather than by molding is preferred because it is less expensive and more practical since it does not require the use of complex molds, e.g. provided with slides. Unfortunately, lines of weakness obtained by cutting are conventionally designed to extend in a plane perpendicular to the longitudinal axis of the skirt, as proposed in EP-A-0 619 168, thereby limiting the possibilities for converting the stoppers, unlike with stoppers in which the line of weakness is obtained by molding, it being possible for such molded lines to include, in particular, a non-breakable portion of material that connects the removable skirt portion to the non-removable skirt portion permanently, even after the stopper has been opened.

An object of the present invention is to improve fabrication of stoppers having lines of weakness that are cut and to do so in simple and inexpensive manner, so as to have a stopper in which the removable skirt portion remains connected to the non-removable skirt portion after the stopper has been opened for the first time.

To this end, the invention provides a method of fabricating a stopper for a container neck, as defined in claim 1.

By means of the method of the invention, the line of weakness is cut in the shape of a helix, centered on the axis of the skirt and turning through more than 360° so that, along the axial direction of the skirt, the two peripheral ends of the line are disposed one above the other and they define a non-breakable strip between them. This strip is dimensioned to form a non-breakable link between the removable and the non-removable skirt portions. Thus, when the stopper obtained by implementing the method of the invention is opened for the first time, the breakable bridges break, while the above-mentioned strip remains. The method of the invention is particularly simple to implement, since it requires only limited conversions relative to the existing methods.

Advantageous characteristics of the method of the invention, taken in isolation or in any technically feasible combination, are specified in dependent claims 2 to 4.

The invention also provides a stopper for a container neck, as defined in claim 5.

The stopper is preferably obtained by implementing the above-defined method, with the structural advantages that are mentioned above.

Advantageous characteristics of this stopper, taken in isolation or in any technically feasible combination, are specified in dependent claims 6 to 8.

The invention also provides a machine for fabricating a stopper for a container neck, starting from a tubular skirt suitable for surrounding the neck and provided both with retainer means for retaining it permanently around the neck and also with fastener means for fastening it removably to the neck, this machine being as defined in claim 9.

The machine of the invention makes it possible to implement the method as defined above.

A practical embodiment of this machine is specified in claim 10.

A simple and effective embodiment is specified in claim 11.

The invention can be better understood on reading the following description given merely by way of example and with reference to the accompanying drawings, in which.

Figure 1:
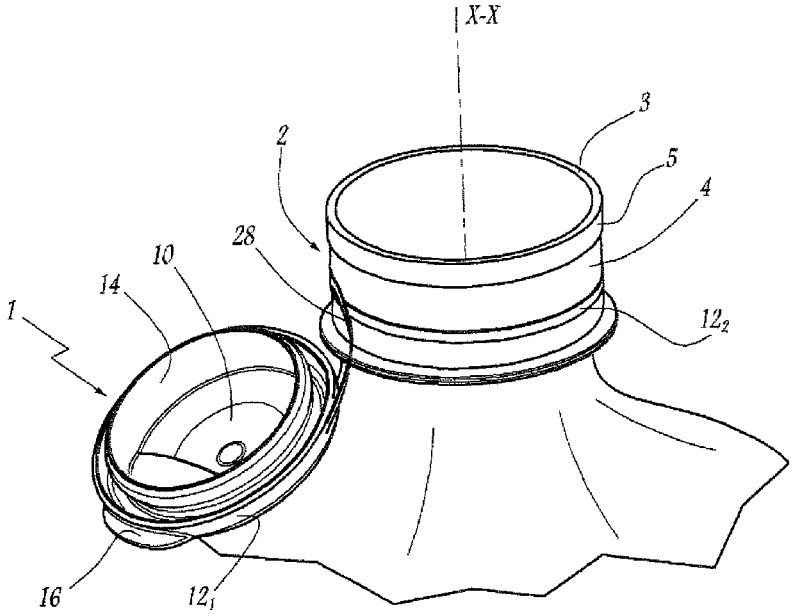
FIG. 1 is a diagrammatic perspective view of a stopper fabricated by implementing a method of the invention, FIG. 1 showing this stopper put in place around a container neck and in an open configuration.
Figure 2:
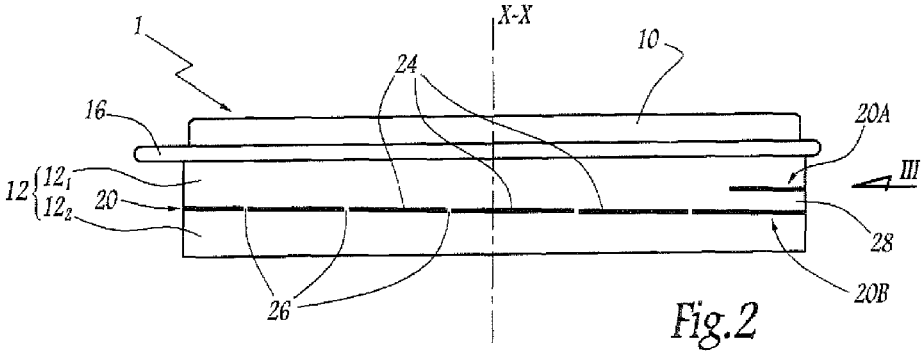
FIG. 2 is a side elevation view of the stopper of FIG. 1 as not yet opened and before it is put in place around the container neck.

FIGS. 1 to 4 show a stopper 1 adapted to being fastened removably to a neck 2 of a container. The stopper 1 that is considered herein by way of illustration is a stopper that may generally be referred to as a "snap-shut" stopper or as a "snap-on" stopper that is fastened by snapping onto the neck 2. In practice, the neck 2 is either formed integrally with the remainder of the container, in particular when said container is a bottle made of glass or of a plastics material, as shown in FIG. 1, or else it is adapted to being secured permanently to a wall of the container, at a through opening in said wall.

The stopper 1 and the neck 2 have respective shapes that are substantially tubular, and that have central longitudinal axes that substantially coincide with each other, as indicated by the reference X-X, when the stopper is snapped onto the neck. For reasons of convenience, the description below considers that the terms "top" and "upwards" correspond to a direction that is substantially parallel to the axis X-X and that goes from the body of the container towards its neck 2, i.e. to a direction going towards the tops of all of the figures except for FIG. 6, whereas the terms "bottom" and "downwards" correspond to the opposite direction.

The neck 2 has a body 4 that is substantially cylindrical with the cylindrical shape having a circular base and being of axis X-X. At its top end, the body 4 defines a rim 3 at which the liquid contained in the container is poured out. As shown in chain-dotted lines in the right portion of FIG. 4 only, on the outside face of the body 4, the neck 2 is provided, at its top end, with an edge 5, and in its main portion, with a projection 6, both the edge and the projection extending radially outwards from the body.

The stopper 1, as considered snapped onto the neck 2, is open at its bottom end and is closed at its top end by an end-wall 10, at the outside periphery of which a tubular skirt 12 extends axially downwards, which skirt is centered on the axis X-X and has a circular base. In this example, the stopper is advantageously provided with a lip 14 that extends axially downwards from the end-wall 10 in such a manner as to be centered on the axis X-X, inside the outer skirt 12. When the stopper is snapped onto the neck 2, the end-wall 10 extends above and across said neck, while the skirt 12 surrounds the body 4 externally and the lip 14 is pressed in leaktight manner against the inside face of said body.

At its top end, the skirt 12 is provided with an external tab 16 that extends radially outwards from a small peripheral portion of the skirt, which portion is considered below as the front of the stopper 1, insofar as it is the side of the stopper that is designed to face the user when the stopper is in service.

In its top portion, the skirt 12 is internally provided with a snapping band 18 that is in the form of a bulge of material that both extends radially inwards from the main wall of the skirt, and also runs around the inside periphery of the skirt, while, in this example, being interrupted over the front of the stopper. In longitudinal section through the stopper, this snapping band has a convex surface that is connected to the end-wall 10 while forming a recess for receiving the edge 5 of the neck 2. Thus, snapping the stopper consists in engaging said convex surface with the bottom end of the edge 5, which edge is then received in the above-mentioned recess, as shown in the right portion only of FIG. 4.

When the stopper 1 is opened for the first time, the skirt 12 is adapted to separate into two distinct portions, namely a top portion $\mathbf{12}_1$, formed integrally with the end-wall 10, and a bottom portion $\mathbf{12}_2$, initially connected to the top portion $\mathbf{12}_1$ at a peripheral line of weakness 20 situated axially in the main portion of the skirt. The skirt portion $\mathbf{12}_1$ is designed to be disengaged in full from the neck 2 so that said portion $\mathbf{12}_1$ externally carries the tab 16 and internally carries the snapping band 18. The skirt portion $\mathbf{12}_2$ is designed to remain around the neck 2. To this end, the portion $\mathbf{12}_2$ is internally provided with a ledge 22 extending radially by projecting inwards from the inside surface of the skirt 12, while running all the way around the periphery of the skirt. When the stopper is assembled on the neck 2, said ledge extends axially below the projection 6 and is adapted, when the stopper is lifted for the first time, to come axially into abutment against said projection.

The line of weakness 20 is made up of peripheral notches 24, each of which passes radially through the wall of the skirt 12. The notches succeed one another along the line 20, in other words around the periphery of the skirt. Each pair of two immediately successive notches defines a breakable bridge 26 between the two notches in the pair, which bridge interconnects the skirt portions $\mathbf{12}_1$ and $\mathbf{12}_2$ in the same direction as the axis X-X.

Figure 4:
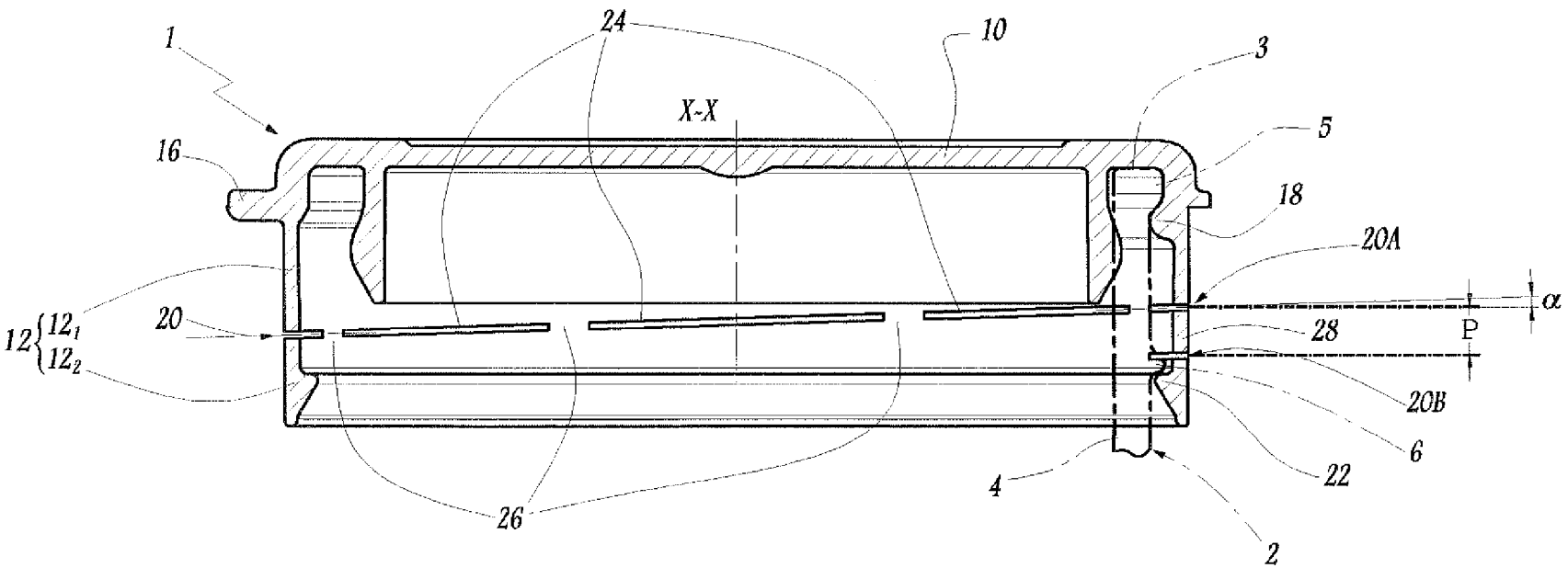
FIG. 4 is a longitudinal section view of the stopper, on the plane IV-IV of FIG. 3.

The line of weakness 20 does not lie within a plane that is perpendicular to the axis X-X, but rather it forms a helix (a circular helix in this example) that is centered on the axis. Thus, projected into a longitudinal section plane of the skirt 12, the line 20 is inclined at an angle $\alpha$ relative to the perpendicular to the axis X-X, as indicated in FIG. 4.

Figure 3:
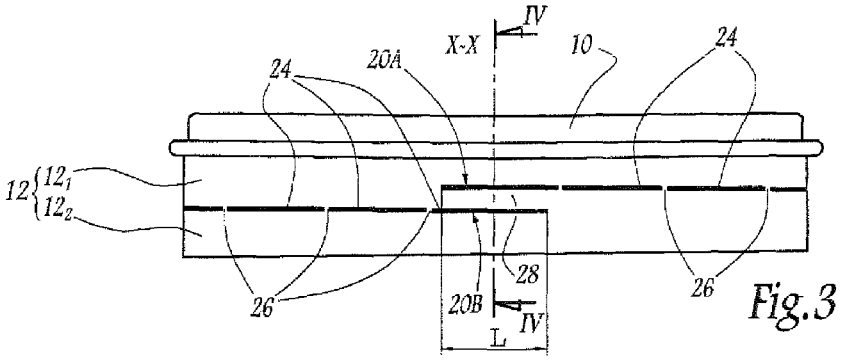
FIG. 3 is an elevation view seen looking along arrow III of FIG. 2.

In addition, the helical line 20 turns through more than 360°, so that the two peripheral ends of the line 20, respectively referenced 20A and 20B, are disposed one above the other in the same direction as the axis X-X, as can be seen clearly in FIG. 3. In this way, the ends 20A and 20B define between them, in the same direction as the axis X-X, a strip of material 28 having a length L, i.e. its dimension extending around the periphery of the skirt 12, that corresponds to the length of the axial overlap of the ends 20A and 20B. This strip 28 forms a non-breakable link between the skirt portions $\mathbf{12}_1$ and $\mathbf{12}_2$: when the stopper 1 is opened for the first time, the skirt portion $\mathbf{12}_1$ is disengaged from the neck 2, thereby breaking the bridges 26 of the line 20, without breaking the strip 28. In this way, a permanent link is formed between the skirt portions $\mathbf{12}_1$ and $\mathbf{12}_2$, so that, insofar as the portion $\mathbf{12}_2$ is retained permanently around the neck 2, the skirt portion $\mathbf{12}_1$ remains connected to the neck, via the strip 28, even when the stopper 1 is open.

In practice, it can be understood that the strip 28 should have breaking strength that is significantly higher than the breaking strength of the breakable bridges 26, this strength of the strip 28 being dependent on its length L, on its thickness that corresponds to the radial thickness of the wall of the skirt 12, and on its axial width that corresponds to the pitch P of the helix formed by the line 20, as well as on the material of which the skirt is made. By way of example, if the stopper 1 is made of a plastics material that is usual for food-grade stoppers, and if the skirt 12 has a diameter of about 25 millimeters (mm) with a wall thickness of about 0.5 mm, the angle $\alpha$ is chosen to be equal to about 3°, which results in a helix pitch P of about 1 mm.

In order to prevent the portion of the skirt $\mathbf{12}_1$ from interfering with the neck 2 when the stopper 1 is open, provision is made for the length L of the strip 28 to be greater than 5 mm.

Advantageously, the ends 20A and 20B of the line 20 are not provided with bridges along the strip 28, the bridges 26 thus preferably being distributed substantially uniformly along the remainder of the line 20. In this way, when the stopper 1 is opened for the first time, all of the bridges 26 are broken, thereby enabling the ends 20A and 20B to open freely, i.e. the edges of the notches 24 respectively constituting the ends 20A and 20B are free to move apart and thus to enable the strip 28 to be deployed over its entire length L relative to the skirt portions $\mathbf{12}_1$ and $\mathbf{12}_2$.

On the periphery of the skirt 12, the strip 28 is situated substantially diametrically opposite from the tab 16. In this way, the presence of the strip 28 in no way hinders opening the skirt portion $\mathbf{12}_1$ by driving this portion by swinging it about an axis that is circumferential to the axis X-X and situated behind the skirt 12, by pushing against the tab 16 with the fingers.

Figure 5:
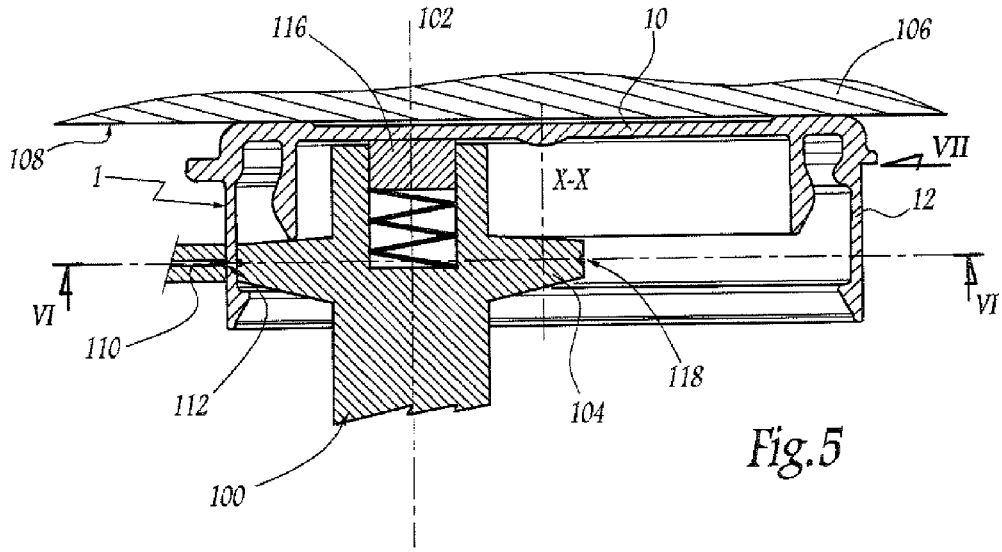
FIG. 5 is a diagrammatic view showing a machine for fabricating the stopper of the invention that is shown in FIGS. 1 to 4.
Figure 7:
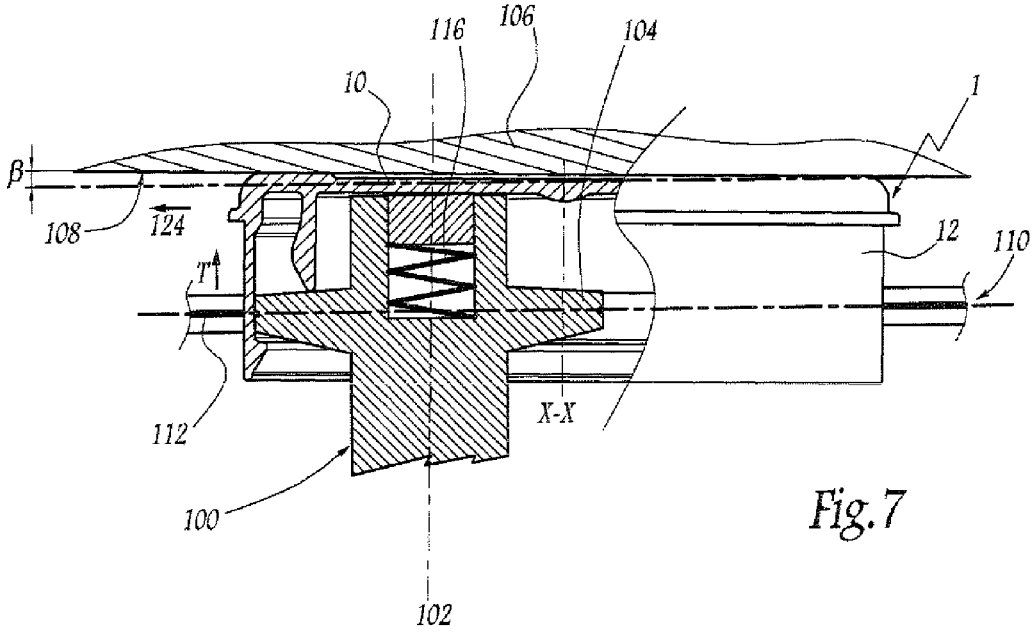
FIG. 7 is a diagrammatic elevation view seen looking along arrow VII of FIG. 5.
Figure 6:
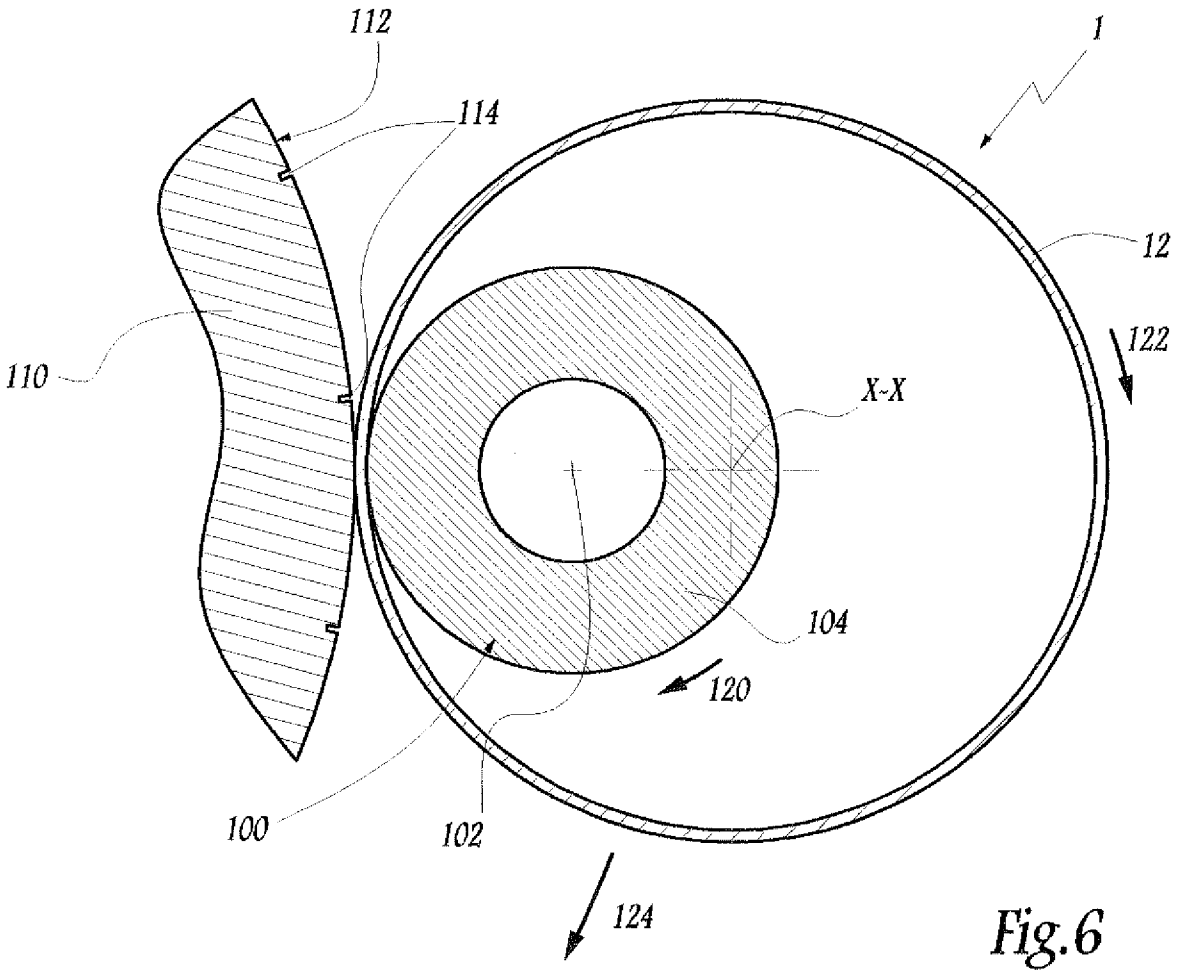
FIG. 6 is a diagrammatic section view on the plane VI-VI of FIG. 5.

There follows a description of an example of a method making it possible to fabricate the stopper 1 by using the fabricating machine shown in FIGS. 5 to 7. This machine includes:

- a chuck 100 mounted to rotate about its own central longitudinal axis 102 and provided with an end head 104 suitable for being inserted into the skirt 12;
- a support plate 106 that, facing the head 104, defines a plane bearing surface 108 for the end-wall 10; and a cutting blade 110 defining a sharp free edge 112 provided with nicks 114 distributed along its length.

In order to fabricate the stopper 1 by means of the machine shown in FIGS. 5 to 7, there is provided initially the skirt 12 that is both closed by the end-wall 10 and also provided with the lip 14, with the tab 16, and with the snapping band 18. This skirt is obtained, in particular, by molding a plastics material.

The head 104 is then inserted into the skirt 12, while interposing axially between said head and the end-wall 10 a resilient compression pusher 116 so that said pusher holds the end-wall 10 pressed against the surface 108 of the support plate 106, with the axis X-X perpendicular to said surface. By radially offsetting the axis 102 relative to the axis X-X, the head 104 presses the skirt 12 against the sharp edge 112 of the blade 110, in a direction substantially radial to the axis X-X.

The chuck 100 is then driven in rotation about its own axis 102, as indicated by the arrow 120 in FIG. 6, so as to cause the skirt 12 to roll against the edge 112 of the blade 110, as indicated by the arrow 122, the skirt then, considered as a whole, following the path 124 along the edge 112. Said edge cuts through the wall of the skirt 12 and thus forms the notches 24, while, on going over each nick 114 in the blade 110, the wall of the skirt is not cut, thereby forming the bridges 26. The head 104 is provided with a peripheral groove 118 that receives the end of the sharp edge 112 when said edge passes through the wall of the skirt.

While the skirt 12 and the blade 110 are moving in rotation relative to each other, the end-wall 10 slides against the support plate 106, while being held pressed against the surface 108 by the pusher 116. This surface 108 is not strictly parallel to the blade 110, but rather it is inclined relative thereto, at an angle referenced β in FIG. 7, in the same direction as the path 124. In this way, the blade 110 does not cut the skirt 12 in a plane that is strictly perpendicular to the axis X-X, but rather it cuts said skirt along a helical path so as to form the line of weakness 20 as described above with reference to FIGS. 2 to 4. As the chuck 100 drives the skirt 112, the position of said skirt, along its axis X-X, is modified relative to the blade 110 by a movement in translation T that is both parallel to the axis X-X and also directed in a single direction, as indicated in FIG. 7. It can be understood that the skirt 12 moves in translation progressively relative to the blade 110, while they are moving in rotation relative to each other, due to the continuous inclination of the surface 108, the angle of inclination β of said surface thus corresponding to the angle α relative to the helical shape of the line 20.

At the same time, in order to enable the ends 20A and 20B of the line 20 to be situated one above the other in the same direction as the axis X-X, the skirt 12 and the blade 110 are moved in rotation relative to each other through a total angular stroke that is strictly greater than 360°. In practice, this stroke is preferably greater than 375°, with a view to obtaining a sufficient length L for the strip 28.

To make the pitch P of the helix-shape of the line 20 greater than or equal to 1 mm, provision is made for the skirt 12 to move in translation by at least 0.5 mm relative to the blade 110 while the skirt moves exactly through one turn about its axis.

Figure 8:
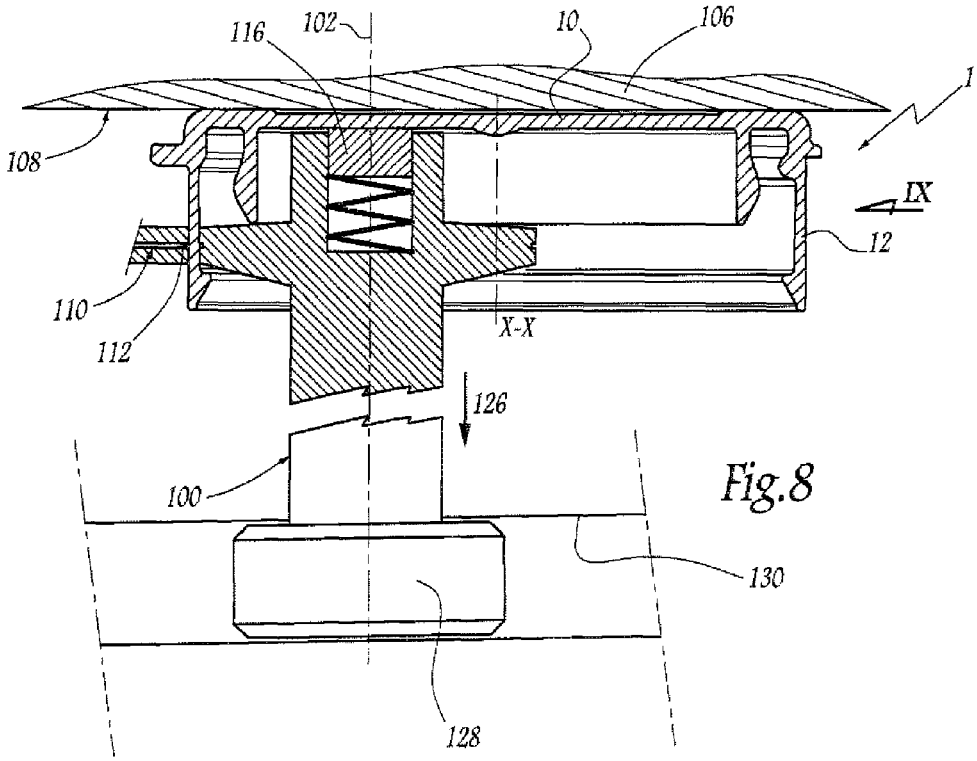
FIG. 8 is a diagrammatic view of another embodiment of a machine for fabricating the stopper of the invention that is shown in FIGS. 1 to 4.
Figure 9:
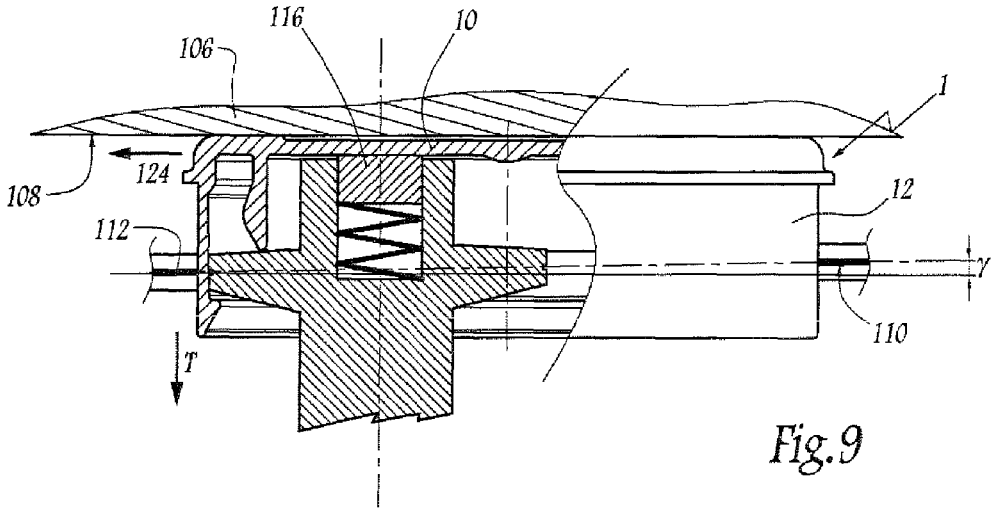
FIG. 9 is a diagrammatic elevation view seen looking along arrow IX of FIG. 8.

FIGS. 8 and 9 show an alternative embodiment of the machine of FIGS. 5 to 7, making it possible to fabricate the stopper 1. This alternative embodiment includes the same components, namely the chuck 100, the support plate 106, the cutting blade 110, and the pusher 116. It differs from the embodiment of FIGS. 5 to 7 by the fact that the surface 108 of the plate 106 extends perpendicularly to the axis 102 of the chuck 100. In order to enable the notches 24 to be cut out along the helical path of the line 20, the blade 110 is, in this example, inclined relative to the surface 108 in the same direction as the path 124, at an angle referenced γ in FIG. 9. The angle of inclination γ corresponds to the angle α relative to the helical shape of the line 20. In this way, while the skirt 12 and the blade 110 are being driven in rotation relative to each other, the axial position of the portion of the blade that cuts the notches in the skirt is progressively modified relative to the skirt by a movement in translation T that is identical, ignoring direction, to the movement in translation described above with reference to FIGS. 5 to 7.

In practice, it is necessary for the groove 118 to follow axially the edge 112 that cuts notches in the skirt 12, so that the chuck 100 is designed to move along its axis 102 in a movement in translation T, as indicated by the arrow 126 in FIG. 8. For this purpose, the chuck 100 is, for example, equipped with a cam 128 that co-operates with a suitable cam path 130.

Various conversions and variants may be made to the method, to the stopper 1, and to the machine that are described above. By way of example:

it is recalled that the stopper 1 may be removably fastened to the neck 2 otherwise than by snapping, and in particular by screw-fastening, the skirt portion $\mathbf{12}_1$ then being provided with an inside thread suitable for being screwed and unscrewed around a complementary outside thread defined by the neck;

the outside surface of the skirt 12 may be provided with fluting in the same direction as the axis X-X, or more generally be provided with pieces in relief suitable for co-operating with an outside sector of the structure of the blade 110 in order to improve the rotary drive of the skirt about the axis X-X;

the snapping band 18 may extend over the entire periphery of the skirt or, conversely, be fragmented into a plurality of distinct clips; and/or the skirt portion $\mathbf{12}_2$ may be retained permanently around the neck 2 by embodiments other than the ledge 22.

The invention claimed is:

1. A stopper for a container neck, wherein the stopper includes:

a tubular skirt suitable for surrounding the neck and provided with a peripheral line of weakness that is cut and made up firstly of through notches that are cut and succeed one another around the periphery of the skirt, and secondly, between said notches, of breakable bridges that are adapted to being broken when the stopper is opened for the first time and that, before the stopper is opened for the first time, interconnect a non-removable portion of the skirt, which portion is provided with retainer means for retaining the non-removable portion permanently around the neck, and a removable portion of the skirt, which portion is provided with fastener means for fastening the removable portion removably to the neck; and wherein the line of weakness is a single continuous helix having a first end and a second end, the line of weakness extending between the first end and the second end, and turning through more than 360° so that the second end is disposed above the first end, and the first and second ends define a non-breakable strip between them.

2. A stopper according to claim 1, wherein the strip has a length around the periphery of the skirt of at least 5 mm.

3. A stopper according to claim 1, wherein a portion extending from the first end of the line of weakness and a portion extending from the second end of the line of weakness are not provided with any bridges.

4. A stopper according to claim 1, wherein the removable portion of the skirt is provided with an external drive tab extending over a portion only of the periphery of the skirt and making it possible to drive the removable portion manually so as to disengage it from the neck, and wherein the strip is situated in a peripheral portion of the skirt that is diametrically opposite from the portion associated with the tab.

5. A machine for fabricating the stopper according to claim 1, said machine including:

a cutting blade for cutting the skirt and drive means for driving the skirt and the blade in rotation relative to each other;

wherein the cutting blade is configured to cut the line of weakness in the skirt, wherein the drive means for driving the skirt and the blade in relative rotation are suitable for driving the skirt and the blade in rotation about a longitudinal axis of the skirt through an angular stroke that is greater than 360°, and wherein the machine further includes means for modifying the relative axial position between the skirt and the blade by a movement in axial translation.

6. A machine according to claim 5, wherein the drive means for driving the skirt and the blade in rotation relative to each other comprises a rotary chuck for causing the skirt to roll against the blade so that the rotary chuck moves in rotation about its own axis, and wherein the means for modifying the axial position comprises both a support plate that is inclined relative to the blade and a resilient compression element, interposed axially between the chuck and an end-wall of the stopper, from which end-wall the skirt extends in the same direction as the axis of the skirt, for holding said end-wall pressed against the support plate.

7. A machine according to claim 6, wherein the chuck extends perpendicularly to the support plate and is provided both with a groove for receiving a sharp edge of the blade when said sharp edge passes through the skirt for performing the cutting, and wherein the chuck is also provided with a drive cam for driving the chuck in axial translation relative to the skirt.

8. A method of fabricating the stopper according to claim 1, wherein the skirt and a blade are moved in rotation relative to each other about a longitudinal axis of the skirt so that the blade cuts the line of weakness in the skirt;

wherein the skirt and the blade are driven relative to each other through an angular stroke that is greater than 360° about the axis of the skirt; and wherein, while the skirt and the blade are being driven in rotation relative to each other, the relative axial position between the skirt and the blade is modified by a movement in axial translation.

9. A method according to claim 8, wherein the skirt and the blade are driven in rotation relative to each other through an angular stroke that is greater than 375° about the axis of the skirt.

10. A method according to claim 8, wherein, while the skirt and the blade are being driven in rotation relative to each other through 360° about the axis of the skirt, the relative axial position between the skirt and the blade is modified by at least 0.5 mm.

11. A method according to claim 8, wherein, while the skirt and the blade are being driven relative to each other, an end-wall of the stopper, from which end-wall the skirt extends in the same direction as its axis, is held pressed against a support plate that is inclined relative to the blade.

* * * * *